US007664436B2

(12) United States Patent
Aoki et al.

(10) Patent No.: US 7,664,436 B2
(45) Date of Patent: Feb. 16, 2010

(54) COLOR ELECTROPHOTOGRAPHIC IMAGE FORMING APPARATUS

(75) Inventors: Daisuke Aoki, Numazu (JP); Shigeo Miyabe, Numazu (JP); Takahito Ueno, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 76 days.

(21) Appl. No.: 12/113,579

(22) Filed: May 1, 2008

(65) Prior Publication Data

US 2008/0286010 A1 Nov. 20, 2008

(30) Foreign Application Priority Data

May 15, 2007 (JP) ..... 2007-128984
Apr. 23, 2008 (JP) ..... 2007-112002

(51) Int. Cl.
*G03G 15/04* (2006.01)
*G03G 15/01* (2006.01)

(52) U.S. Cl. ..... 399/227; 399/119

(58) Field of Classification Search ..... 399/119, 399/227

See application file for complete search history.

(56) References Cited

U.S. PATENT DOCUMENTS 5,258,819 A 11/1993 Kimura et al.
5,585,598 A * 12/1996 Kasahara et al. ..... 399/227
5,835,825 A * 11/1998 Maruta ..... 399/227
6,122,469 A 9/2000 Miura et al.
6,282,395 B1 8/2001 Nittani et al.
6,438,347 B2 8/2002 Nittani et al.
6,917,778 B2 * 7/2005 Gumbe ..... 399/227
2005/0123322 A1 6/2005 Okamoto et al.
2005/0191091 A1 9/2005 Isobe et al.

FOREIGN PATENT DOCUMENTS

JP 63-78179 A 4/1988
JP 7-301982 A 11/1995
JP 2002-365878 A 12/2002
JP 2005-148319 6/2005

OTHER PUBLICATIONS

Japanese Office Action dated Nov. 11, 2008 in Japanese Application No. 2008-112002.
European Search Report dated Jul. 25, 2008 in European Application No. 08156237.3—1240.

* cited by examiner

*Primary Examiner*—David M Gray
*Assistant Examiner*—Joseph S Wong
(74) *Attorney, Agent, or Firm*—Fitzpatrick, Cella, Harper & Scinto

(57) ABSTRACT

A color electrophotographic image forming apparatus which simplifies a configuration in which a rotary is rotated to change over respective developing devices to a development position to reduce the costs and save the space, and which simplifies the changeover operation to reduce an operating time. The image forming apparatus sequentially moves and changes over the respective developing devices supported by the rotary to the development position which faces a photosensitive drum by the rotation of the rotary. The rotary is rotated to move the developing devices. A cam is rotated integrally with the rotary, and thereby abutment portions of the cam are abutted against a regulating rotatable member so that the developing devices are spaced from a photosensitive drum. In a state in which the developing devices are abutted against the photosensitive drum, the cam is spaced from the regulating rotatable member by recesses of the cam.

12 Claims, 12 Drawing Sheets

COLOR ELECTROPHOTOGRAPHIC IMAGE FORMING APPARATUS

BACKGROUND OF THE INVENTION

1. Field of the Invention

The present invention relates to a color electrophotographic image forming apparatus that uses a rotary supporting member (rotary) which supports plural developing devices and is rotatable.

2. Description of the Related Art

Up to now, there has been known a color electrophotographic image forming apparatus that uses a rotary supporting member (rotary) which supports plural developing devices and is rotatable. In the image forming apparatus, the rotary supporting member is rotated. With the operation, the plural developing devices that are supported by the rotary supporting member are sequentially moved to a development position that faces a photosensitive drum. Also, the rotary supporting member is pivotably disposed with respect to an apparatus main body. With the above configuration, the developing devices are brought in contact with or spaced from a photosensitive drum (refer to Japanese Patent Application Laid-open No. 2005-148319).

In more detail, the rotary supporting member (rotary) is rotatably supported by a pivotably movable member that is pivotably movable with respect to the apparatus main body. Upon receiving a drive force from a drive motor, the rotary supporting member rotates. With the above operation, the developing devices (developing portions) are sequentially moved to the development position. A cam that rotates upon receiving the drive force is rotatably disposed in the pivotably movable member. The cam rotates and is engaged with an engagement portion that is disposed in the apparatus main body. With the above configuration, the pivotably movable member S pivotably moves, and the developing devices are spaced from the photosensitive drum.

As described above, the conventional art requires the cams and the drive transmission mechanism that rotates the cams in order to pivotably move the pivotably movable member. Under the above circumstances, a space in which those members are incorporated into the interior of the apparatus is required. This causes a factor that prevents the image forming apparatus from being downsized.

SUMMARY OF THE INVENTION

Under the above circumstances, an object of the present invention is to provide a color electrophotographic image forming apparatus that simplifies a configuration in which developing devices are positioned to a development position.

Another object of the present invention is to provide a color electrophotographic image forming apparatus that simplifies a configuration in which the developing devices are retreated from the development position.

Still another object of the present invention is to provide a color electrophotographic image forming apparatus that realizes moving the developing devices in a state in which the developing devices are far from the development position in an intersecting direction which intersects with the rotating direction of the rotary supporting member when the developing devices are moved by the rotation of the rotary supporting member.

Yet still another object of the present invention is to provide a color electrophotographic image forming apparatus that is capable of moving the supported developing devices to the development position from the rotating direction of the rotary supporting member, and moving the supported developing devices to the development position from the intersecting direction which intersects with the rotating direction.

Yet still another object of the present invention is to provide a color electrophotographic image forming apparatus that simplifies the configuration in which the developing devices are positioned to the development position to realize downsizing of the image forming apparatus.

Yet still another object of the present invention is to provide a color electrophotographic image forming apparatus that simplifies the configuration in which the respective developing devices are sequentially positioned to the development position to reduce an operating time required to exchange one developing device that is positioned at the development position with another developing device.

Yet still another object of the present invention is to provide a color electrophotographic image forming apparatus that simplifies a configuration in which the respective developing devices are moved to the development position by rotating the rotary supporting member.

Yet still another object of the present invention is to provide a color electrophotographic image forming apparatus that simplifies the configuration in which the respective developing devices are moved to the development position by rotating the rotary supporting member, thereby realizing the low costs and space saving, and reducing the operating time required to exchange one developing device which is positioned at the development position with another developing device.

In order to achieve the above-mentioned objects, according to a representative configuration of the present invention, a color electrophotographic image forming apparatus which forms an image on a recording medium, includes: an electrophotographic photosensitive drum; a rotary supporting member which supports a plurality of developing devices for developing an electrostatic latent image formed on the electrophotographic photosensitive drum, and rotates to sequentially move in a rotating direction the supported plurality of developing devices to a development position at which the electrostatic latent image is developed; a motor; a pivotally movable member which pivotably supports the rotary supporting member; a rotary member which rotates integrally with the rotary supporting member which rotates while receiving a rotating force from the motor, the rotary member including a spacing portion for moving one of the plurality of developing devices which is supported by the rotary supporting member to the development position in an intersecting direction intersecting with the rotating direction of the rotary supporting member, and a contacting portion for moving one of the plurality of developing devices to a retreat position to which one of the plurality of developing devices is retreated from the development position in the intersecting direction; and a regulating member which regulates a pivotal movement of the rotary supporting member in a state in which the regulating member is in contact with the contacting portion, the regulating member being disposed at a position facing the spacing portion which rotates according to a rotation of the rotary member (a guide member) at a distance in order to move one of the plurality of developing devices to the development position in the intersecting direction, and at a position in which the regulating member contacts the contacting portion which rotates according to the rotation of the rotary member (the guide member) in order to move one of the plurality of developing devices to the retreat position in the intersecting direction, wherein the rotary supporting member pivotally moves so that one of the plurality of developing devices is positioned at the development position in a state in which the regulating member is apart from the spacing portion, and so that one of the plurality of developing devices is positioned at the retreat position in a state in which the regulating member is in contact with the contacting portion.

According to the present invention, the configuration in which the developing device is positioned to the development position can be simplified.

According to the present invention, there is provided the color electrophotographic image forming apparatus which realizes moving the developing devices in a state in which the developing devices are far from the development position in an intersecting direction which intersects with the rotating direction of the rotary supporting member when the developing devices are moved by the rotation of the rotary supporting member.

According to the present invention, it is possible to move the supported developing device to the development position from the rotating direction of the rotary supporting member, and to move the supported developing device to the development position from the intersecting direction which intersects with the rotating direction. With the above configuration, according to the present invention, the developing device which is supported by the rotary supporting member can be rotationally moved in a state in which the developing device is farther away from the electrophotographic photosensitive drum in a direction crossing the rotating direction.

Also, according to the present invention, the configuration in which the developing device is positioned to the development position can be simplified to realize downsizing of the image forming apparatus.

Further, according to the present invention, the configuration in which the respective developing devices are sequentially positioned to the development position can be simplified to enable a reduction in the operating time required to exchange one developing device which is positioned at the development position with another developing device.

Still further, according to the present invention, the configuration in which the respective developing devices are moved to the development position by rotating the rotary supporting member can be simplified.

Still further, according to the present invention, the configuration in which the respective developing devices are moved to the development position by rotating the rotary supporting member can be simplified to realize the low costs and space saving, and to reduce the operating time required to exchange one developing device which is positioned at the development position with another developing device.

Hereinafter, exemplary embodiments of the present invention are described by way of example referring to the drawings. Note that dimensions, materials, shapes, and relative arrangements of the components described in the following embodiments should be modified where appropriate according to the configuration of the apparatus to which the present invention is applied and various conditions. Accordingly, it is not intended to limit the scope of the present invention to those specific embodiments unless specifically stated otherwise.

DESCRIPTION OF THE EMBODIMENTS

First Embodiment

Figure 1:
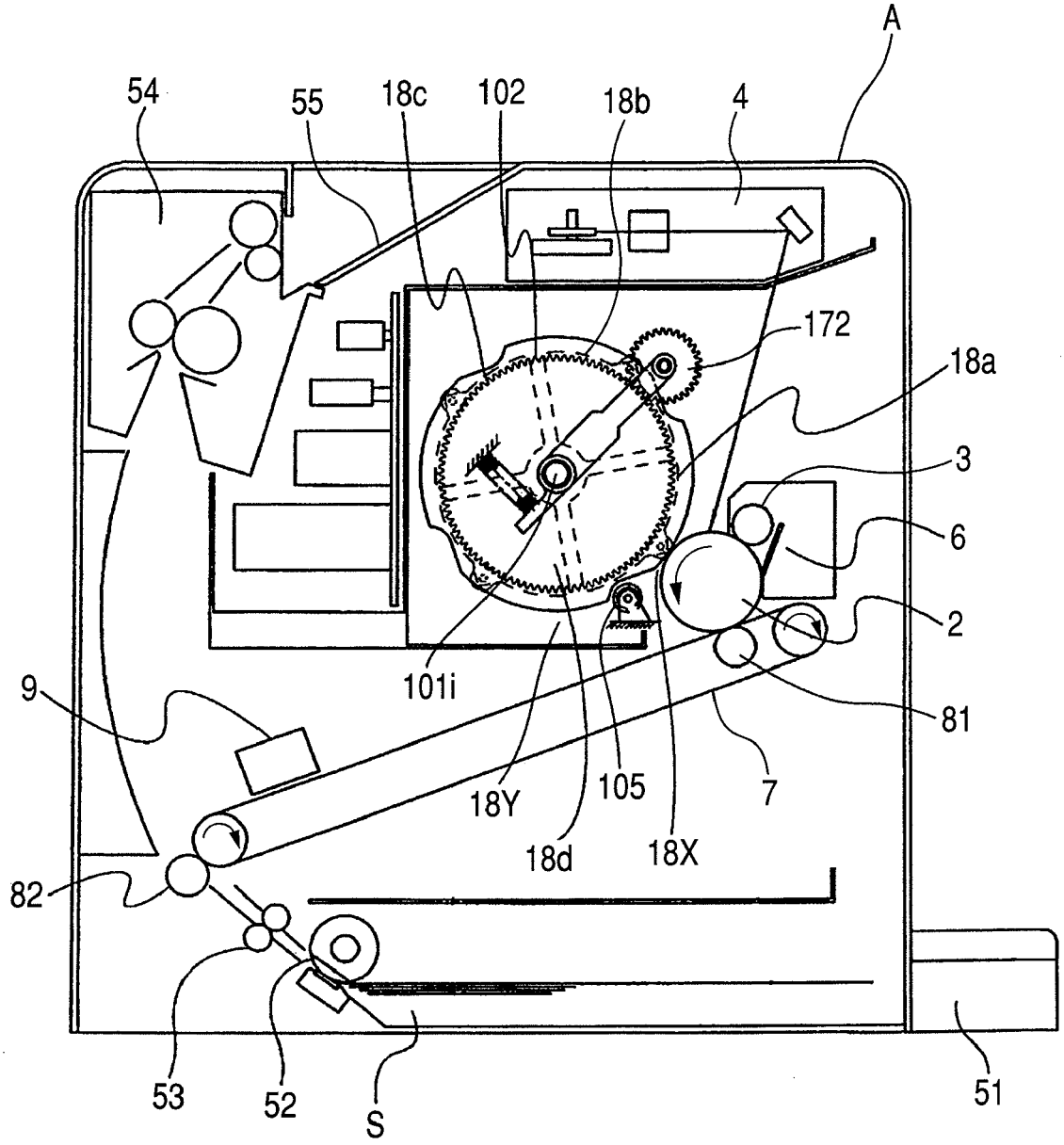
FIG. 1 is a cross-sectional view illustrating a general configuration of a laser beam printer which is an example of an image forming apparatus.

A color electrophotographic image forming apparatus according to a first embodiment is described below. In this example, the color electrophotographic image forming apparatus is exemplified by a color laser beam printer having four developing devices. FIG. 1 is a cross-sectional view illustrating the color laser beam printer.

First, the image forming operation of the color laser beam printer is described.

As illustrated in FIG. 1, the image forming apparatus includes an electrophotographic photosensitive drum 2. A charging roller 3, an exposure unit 4, four developing devices 18*a* to 18*d*, and a cleaning device 6 are arranged around the photosensitive drum 2. The charging roller 3 is charging means for uniformly charging the photosensitive drum 2. The exposure unit 4 is exposing means for irradiating the photosensitive drum 2 with a laser beam corresponding to image information. The photosensitive drum 2 which has been electrically charged is irradiated with the laser beam to form an electrostatic latent image on the photosensitive drum 2. The developing devices 18*a* to 18*d* are developing means for developing the latent image which has been formed on the photosensitive drum 2 with developers of corresponding colors to visualize the image.

The developing device 18*a* contains a yellow developer and develops the electrostatic latent image with the yellow developer. Also, the developing device 18*b* contains a magenta developer and develops the electrostatic latent image with the magenta developer. The developing device 18*c* contains a cyan developer and develops the electrostatic latent image with the cyan developer. The developing device 18*d* contains a black developer and develops the electrostatic latent image with the black developer. That is, the developing devices 18*a* to 18*d* develop the electrostatic latent image which has been formed on the photosensitive drum 2.

The cleaning device 6 is cleaning means for removing the developer which remains on the surface of the photosensitive drum 2.

First, the photosensitive drum 2 is made to rotate in synchronism with the rotation of an intermediate transfer belt 7 in a direction (counterclockwise) indicated by an arrow in FIG. 1. Then, the surface of the photosensitive drum 2 is uniformly charged by the charging roller 3. Simultaneously, the yellow image is irradiated with the beam by the exposing unit 4 to form the electrostatic latent image of yellow on the photosensitive drum 2.

Together with the formation of the electrostatic latent image, a rotary (rotary supporting member) 102 which supports the four developing devices 18*a* to 18*d* and is rotatable is rotated by a drive transmission mechanism to be described later to position the developing device 18*a* of yellow to a development position 18X which faces the photosensitive drum 2. At the development position 18X, a development roller 182*a* disposed in the developing device 18*a* is in contact with the photosensitive drum 2. In this situation, a voltage having the same polarity as the charge polarity of the photosensitive drum 2 and the substantially same potential is applied to the development roller 182*a* so that the yellow developer is stuck onto the electrostatic latent image on the photosensitive drum 2. With the above operation, the electrostatic latent image is developed with the yellow developer. That is, the rotary 102 supports the plural developing devices 18*a* to 18*d*, and rotates, to thereby sequentially move the supported plural developing devices one by one to the development position 18X which faces the photosensitive drum 2. The developing device which has been positioned at the development position develops the electrostatic latent image according to the color of the contained developer. In this embodiment, an elastic roller having a metal shaft 182m (FIGS. 3 and 5) coated with rubber is used as the development rollers 182*a* to 182*d*. Note that, in this embodiment, each of the development rollers 182*a* to 182*d* is in contact with the photosensitive drum 2 at the development position 18X (contact development system). Each of the development rollers 182*a* to 182*d* develops the electrostatic latent image in a state in which each of the development rollers 182*a* to 182*d* is in contact with the photosensitive drum 2. However, the present invention is not limited to the above configuration. The present invention is also applicable to a configuration in which the latent image is developed in a state in which each of the development rollers and the photosensitive drum 2 are out of contact with each other but in proximity to each other at the development position 18X. Even with the above configuration, the advantages to be described later can be obtained.

Thereafter, a voltage which is reverse in polarity to the developer is applied to a primary transfer roller 81 which is arranged inside of the transfer belt 7. With the above operation, the developer image of yellow which has been formed on the photosensitive drum 2 is primarily transferred to the transfer belt 7.

The primary transfer of the yellow developer image is completed in the above manner. Then, the developing devices (18*b* to 18*d*) of the respective colors of magenta, cyan, and black are sequentially rotationally moved by the rotation of the rotary 102 so as to be positioned to the development position 18X which faces the photosensitive drum 2. Then, the formation, the development, and the primary transfer of the electrostatic latent image are sequentially conducted on the respective colors of magenta, cyan, and black in the same manner as the case of yellow. As a result, the developer images of four colors are superimposed on the transfer belt 7.

During the above operation, a secondary transfer roller 82 is out of contact with the transfer belt 7. In this situation, the cleaning unit 9 that removes the residual toner on the transfer belt 7 is also out of contact with the transfer belt 7.

On the other hand, sheets S as recording medium are stored in a cassette 51 that is disposed at a lower portion of the apparatus. The recording medium is a member that forms the developer image, for example, a recording paper, or an OHP sheet. The sheets S are separated and fed from the cassette 51 by a feed roller 52 one by one, and fed to a pair of registration rollers (transport rollers) 53. The pair of rollers 53 feeds the fed sheet S to an interspace between the transfer belt 7 and the transfer roller 82. In this situation, the transfer roller 82 and the transfer belt 7 are in pressure contact with each other. (a state illustrated in FIG. 1).

Also, a voltage that is reverse in polarity to the developer is applied to the transfer roller 82, and the developer images of four colors that have been superimposed on the transfer belt 7 are transferred (secondarily transferred) onto the surface of the transported sheet S together.

The sheet S to which the developer image has been transferred is transported to a fixing unit 54. In the fixing unit 54, the sheet S is heated and pressurized to fix the developer image onto the sheet S. As a result, a color image is formed on the sheet S. Then, the sheet S is discharged to a discharge unit of an upper cover 55 in the exterior of the apparatus from the fixing unit 54.

Figure 2:
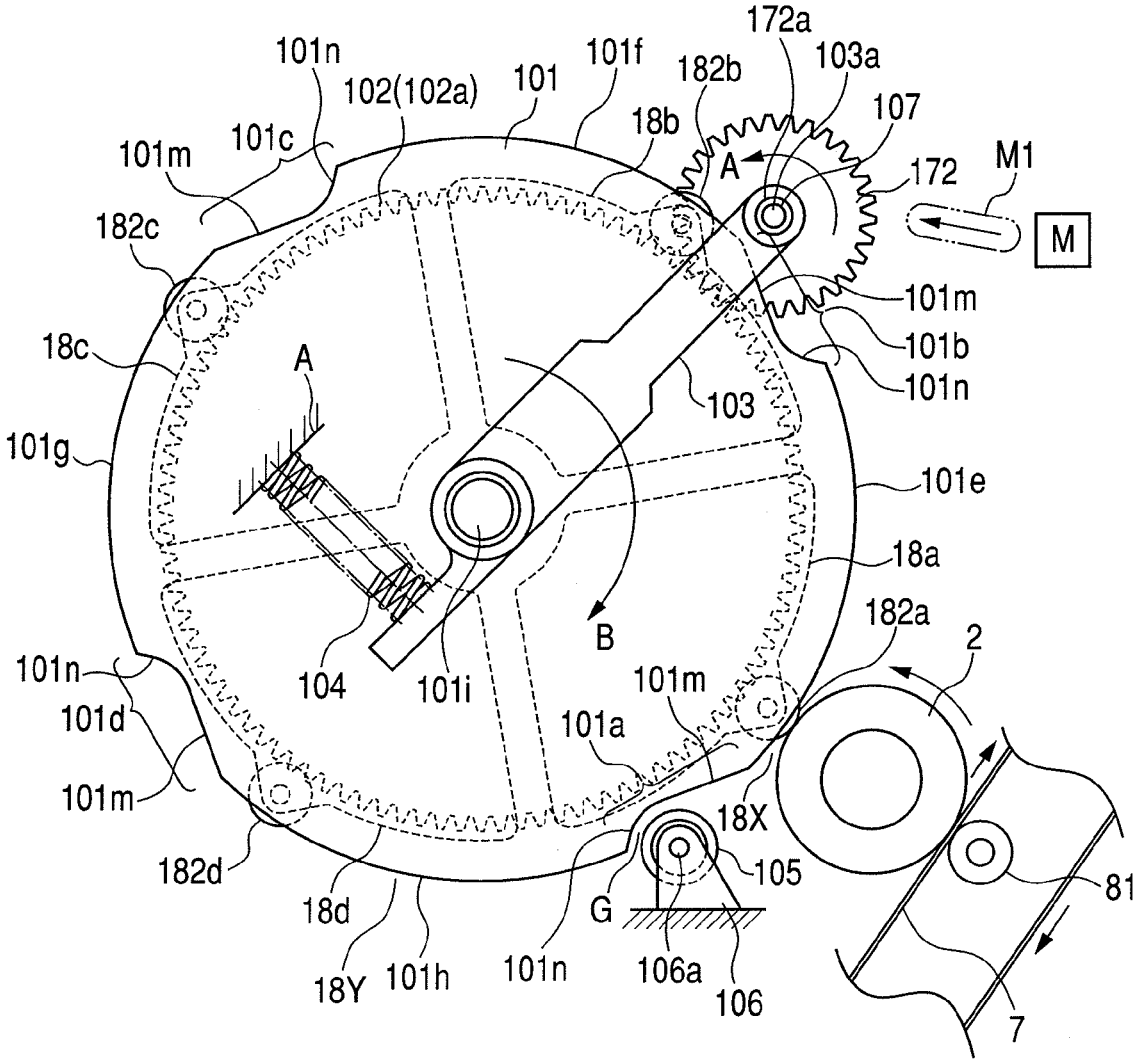
FIG. 2 is a front view illustrating a configuration of a changeover mechanism of a developing device according to a first embodiment.
Figure 3:
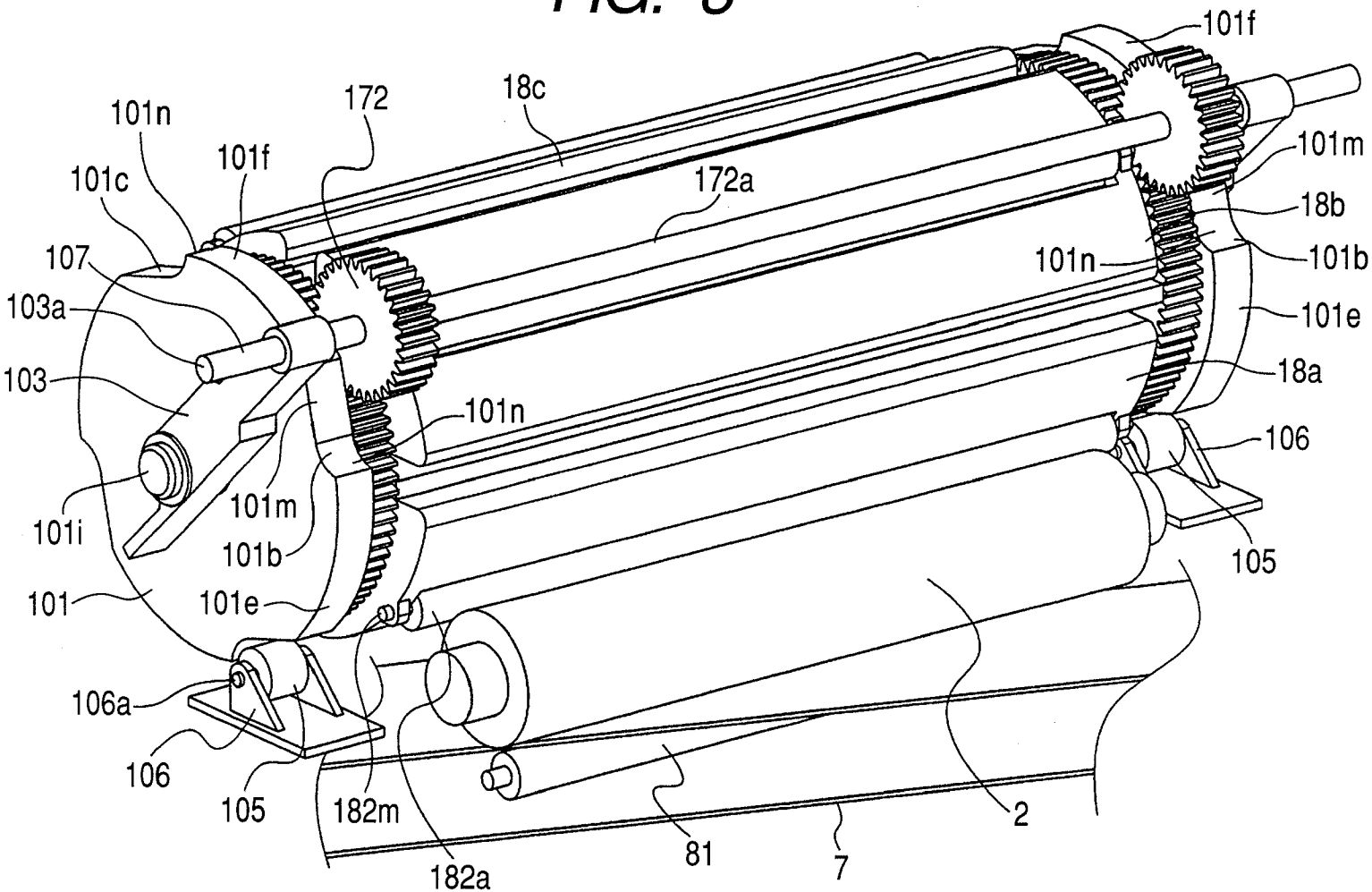
FIG. 3 is a perspective view illustrating the configuration illustrated in FIG. 2.

Next, the drive transmission mechanism that rotates the rotary (rotary supporting member) 102 is described with reference to FIGS. 2 and 3. FIG. 2 is a front view illustrating the configuration of the drive transmission mechanism. FIG. 2 illustrates a state in which the development roller 182*a* of the developing device 18*a* is positioned at the development position 18X that faces the photosensitive drum 2. FIG. 3 is a right side view of FIG. 2 viewed from a right direction. Note that FIG. 2 does not illustrate a main body frame 171 illustrated in FIG. 3. Also, FIG. 3 does not illustrate the transfer belt 7 and the transfer roller 81 illustrated in FIG. 2.

The drive transmission mechanism illustrated in FIGS. 2 and 3 rotates the rotary 102, to thereby sequentially switch and move the respective four developing devices 18*a* to 18*d* that are supported by the rotary 102 to the development position which faces the photosensitive drum 2. Hereinafter, the configuration of the drive transmission mechanism is described.

A drive gear 172 is rotatably supported (disposed) to a shaft 107 that is rotatably supported by the image forming apparatus main body A. The gear 172 rotates upon receiving a rotating force from a motor M (drive source) (FIG. 2).

Note that, a rotating force transmission mechanism M1 that transmits the rotating force from the motor M to the gear 172 is, for example, a gear train or a geared belt, or the like, and can be appropriately applied with a configuration that can transmit the rotating force. Also, the rotating force transmission mechanism M1 cancels the engaged state of gears that constitute the gear train by the aid of, for example, a solenoid. As a result, there can be applied a configuration in which even if the motor M rotates, the rotating force is not transmitted to the gear 172.

An arm 103 is a pivotably movable member that is pivotably supported (disposed) by the apparatus main body A. That is, one end side of the arm 103 is rotatably disposed on the shaft 107 that is disposed on the main body frame 171. At another end side of the arm 103, a leading end of another end side of the arm 103 that rotatably supports the rotary 102 is fitted with another end of an arm spring (for example, a compression spring) (elastic member) 104 having one end fixed to the apparatus main body A. With the above configuration, the arm 103 receives a biasing force (elastic force, rotating force) in the center of the shaft 107 in a direction indicated by an arrow A (FIG. 2) by means of the elastic force of the arm spring 104.

The rotary 102 supports the plural (four in this example) developing devices 18*a* to 18*d*, and is rotatably supported to the arm 103. That is, the developing devices are fitted to the rotary 102. In this example, the developing devices 18*a* to 18*d* can be fixed to or detachably attached to the rotary 102. The developing device according to this embodiment is a development cartridge that is removably fitted to the rotary 102 by a user. That is, the developing device is detachably attached to the rotary 102. With the above configuration, according to this embodiment, the developing device can be exchanged by the user. Accordingly, the maintenance of the apparatus main body A is easy. Also, a gear portion (rotary supporting member gear) 102*a* is disposed in the rotary 102 along the rotating direction of the rotary 102. The gear portion 102*a* is engaged with the drive gear 172. That is, when the drive gear 172 rotates in the direction indicated by the arrow A (FIG. 2), the rotary 102 rotates in a direction indicated by an arrow B (FIG. 2). Then, when the gear 172 stops rotating, the rotary 102 also stops rotating. Note that, as described above, according to this embodiment, even if the motor M continues to rotate, the gear 172 can stop rotating. This is because when the rotating force is transmitted to the gear 172 from the motor M through the mechanism M1, a part of the mechanism M1 is disconnected by the action of the solenoid (not shown).

A regulating rotatable member 105 is rotatably supported by a rotatable member holder 106 that is located in the apparatus main body A. The regulating rotatable member 105 is a regulating member that regulates the pivotal movement of the rotary 102. Also, when a front layer of the regulating rotatable member 105 is formed of an elastic rubber layer, a noise reduction and secure rotation caused by a high frictional coefficient are enabled. Further, in this embodiment, the regulating rotatable member 105 is rotatably supported by the rotatable member holder 106. However, when the sliding property of the outer peripheral surface of the regulating rotatable member 105 is excellent, it is unnecessary to make the regulating rotatable member 105 rotatable. Also, it is unnecessary to provide the rotatable member. According to this embodiment, the rotatable member 105 is formed of an elastic rotatable member. According to this embodiment, the rotary 102 can be rotated with high precision because of the elastic rotatable member. Also, the noise at the time of rotating the rotary 102 can be reduced. The elastic rotatable member can make only the surface layer elastic (for example, rubber), or the entire member elastic.

Also, the rotatable member 105 is an elastic rotatable member that is rotatably supported by a shaft 106*a* (FIGS. 2, 3, and 4) which is fixed to the apparatus main body A. The shaft 106*a* that supports the rotatable member 105 is so arranged as to be in parallel to the rotating axial line of the rotary 102. When the rotary 102 rotates, the rotatable member 105 is brought in contact with contacting portions 101*e* to 101*h* included in a cam 101 to be described later, and is rotated.

The cam (rotary member) 101 is a rotary member (guide member) that rotates together with the rotary (rotary supporting member) 102. In this embodiment, the cam 101 is separated from the rotary 102, and fitted to the rotary 102. However, the cam 101 and the rotary 102 always move in synchronization. For that reason, both of the cam 101 and the rotary 102 can be integrated together. The cam 101 has the contacting portions 101*e* to 101*h* that come in contact with the rotatable member 105, and spacing portions (abutment release portions) 101*a* to 101*d* that do not come in contact with the rotatable member 105. Each of the spacing portions 101*a* to 101*d* is a recess having the substantially same configuration as the contour of the rotatable member 105. The contacting portions 101*e* to 101*h* and the spacing portions (recesses) 101*a* to 101*d* are arranged in alternating order along the outer peripheral surface of the cam 101 at substantially regular angles from a rotating center 101*i* of the cam 101. The cam 101 is positioned at one ends of the developing devices 18*a* to 18*d* that are supported by the rotary 102 in the longitudinal direction. The cam 101 is also integrated with the rotary 102.

Also, the spacing portions 101*a* to 101*d* are recesses that are recessed at plural portions along a rotating direction B (FIG. 2) of the cam 101. Each of the recesses has a bevel 101*m* at an upstream side which rises from a downstream side toward the upstream side in the rotating direction B. The provision of the bevels 101*m* (FIG. 2) enables the developing devices 18*a* to 18*d* to smoothly move away from the development position 18X in an intersecting direction intersecting with the rotating direction according to the rotation of the rotary 102. That is, in accordance with the rotation of the rotary 102, the contacting portions 101*e* to 101*h* come into contact with the rotatable member 105 to move the developing devices 18*a* to 18*d* from the development position 18X to a retreat position in the intersecting direction. The retreat position is a position in which the developing devices 18*a* to 18*d* (the development rollers 182*a* to 182*d*) are away from the development position 18X in the intersecting direction.

Likewise, each of the recesses has a bevel 101*n* (FIG. 2) at the downstream side which descends from the downstream side toward the upstream side. The provision of the bevels 101*n* enables the developing devices 18*a* to 18*d* to smoothly come close to the development position 18X in the intersecting direction intersecting with the rotating direction according to the rotation of the rotary 102. That is, in accordance with the rotation of the rotary 102, the spacing portions 101*a* to 101*d* get to a position in which the spacing portions 101*a* to 101*d* face to the rotatable member 105 to move the developing devices 18*a* to 18*d* from the retreat position to the development position 18X in the intersecting direction.

However, the bevel 101*n* can be eliminated. For example, the bevel 101 may be a right angle instead of a slope. Also, the slope angles of the bevels 101*m* and 101*n* can be appropriately selected.

Figure 5:
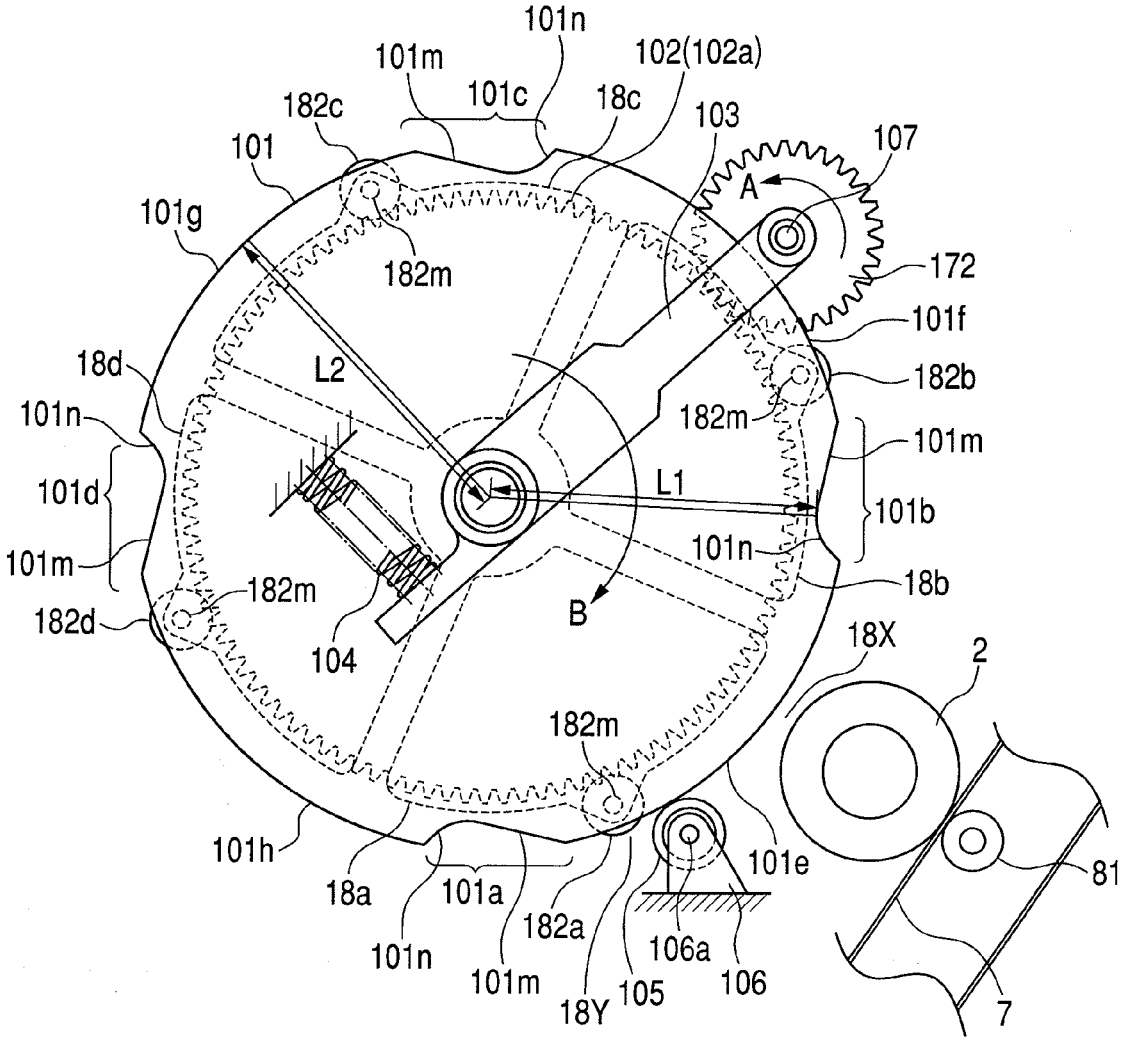
FIG. 5 is a front view of the changeover mechanism when phase of a rotary supporting member illustrated in FIG. 2 is shifted.

For example, as illustrated in FIG. 5, the cam 101 rotates together with the rotary 102. Then, the contacting portion 101*e* is brought in contact with the regulating rotatable member (regulating member) 105, thereby coming to a state in which the development roller 182*a* provided to the developing device 18*a* is spaced from the photosensitive drum 2. Similarly, when the other contacting portions 101*f* to 101*h* are brought in contact with the regulating rotatable member 105, respectively, the development rollers 182*b* to 182*d* of the respective developing devices 18*b* to 18*d* are spaced from the photosensitive drum 2, respectively.

Therefore, the rotatable member (regulating member) 105 is disposed in a position in which the rotatable member faces the spacing portions 101*a* to 101*d* in a state in which the rotatable member is away from the spacing portions 101*a* to 101*d*, which are rotated in accordance with the rotation of the cam 101 in order to move the developing devices 18*a* to 18*d* to the development position 18X in the intersecting direction. Furthermore, the rotatable member 105 is disposed in a position in which the rotatable member comes into contact with the contacting portion 101*e* to 101*h*, which are rotated in accordance with the rotation of the cam 101 in order to move the developing devices 18*a* to 18*d* to the retreat position in the intersecting direction. Then, the rotatable member 105 regulates the pivotal movement of the rotary 102 in a state in which the rotatable member 105 is in contact with the contacting portion 101*e* to 101*h*.

That is, the rotary 102 is pivotally moved so that one of the developing devices 18*a* to 18*d* is positioned in the development position in a state in which the rotatable member 105 is away from the corresponding one of the spacing portions 101*a* to 101*d*. Furthermore, the rotary 102 is pivotally moved so that one of the developing devices 18*a* to 18*d* is positioned in the retreat position in a state in which the rotatable member 105 is in contact with the corresponding one of the contacting portions 101*e* to 101*h*. The structures described above are the same as in the embodiments described later.

As illustrated in FIG. 3, the cam (rotary member) 101, the rotary (rotary supporting member) 102, the arm (pivotably movable member) 103, and the regulating rotatable member (regulating member) 105 are arranged at one end and another end of the supported developing device in the longitudinal direction.

In a state illustrated in FIG. 5, the rotary 102 rotates as is described later. However, in the state illustrated in FIG. 5, the rotary 102 stops rotating, and the rotary 102 is positioned to a standby position 18Y. The standby position 18Y is a state in which the rotary 102 stops rotating and the respective developing devices do not conduct the development. As illustrated in FIG. 5, in that state, the respective development rollers are out of contact with the photosensitive drum 2. For example, the development roller 182*a* is positioned at the standby position 18Y downstream of the rotatable member 105. Also, at the standby position 18Y, the rotatable member 105 supports the lower portion of the rotary 102 that is arranged at the above-mentioned one end. Also, the rotatable member 105 supports the lower portion of the rotary 102 that is arranged at the above-mentioned other end. With the above configuration, the pivotal movement of the rotary 102 that supports the respective developing devices is regulated by the rotatable member 105.

On the other hand, as illustrated in FIG. 2, the rotatable member 105 faces the bottom surface of the recess (spacing portion) 101*a* at a distance in a state in which the development roller 182*a* is in contact with the photosensitive drum 2. This state is a state in which the developing device is positioned at the development position 18X. The rotatable member 105 faces the bottom surface of the recess 101*b* at a distance in a state in which the development roller 182*b* is positioned at the development position 18X so as to be in contact with the photosensitive drum 2. Likewise, the rotatable member 105 faces the bottom surface of the recess 101*c* at a distance in a state in which the development roller 182*c* is positioned at the development position 18X so as to be in contact with the photosensitive drum 2. Also, the rotatable member 105 faces the bottom surface of the recess 101*d* at a distance in a state in which the development roller 182*d* is positioned at the development position 18X so as to be in contact with the photosensitive drum 2. That is, the cam 101 is spaced from the regulating rotatable member 105.

In FIGS. 2 and 3 illustrating the state in which the developing device is conducting development, the rotatable member 105 is disposed close to the recess 101*a* (to 101*d*), and the recess 101*a* (to 101*d*) is arranged in such a manner that the rotatable member 105 and the cam 101 are out of contact with each other. Hence, the arm 103 that are biased by the elastic force of the spring 104 biases the rotary 102. Then, the biasing force (elastic force) becomes a contact pressure between the development roller 182*a* (to 182*d*) and the photosensitive drum 2.

Figure 4:
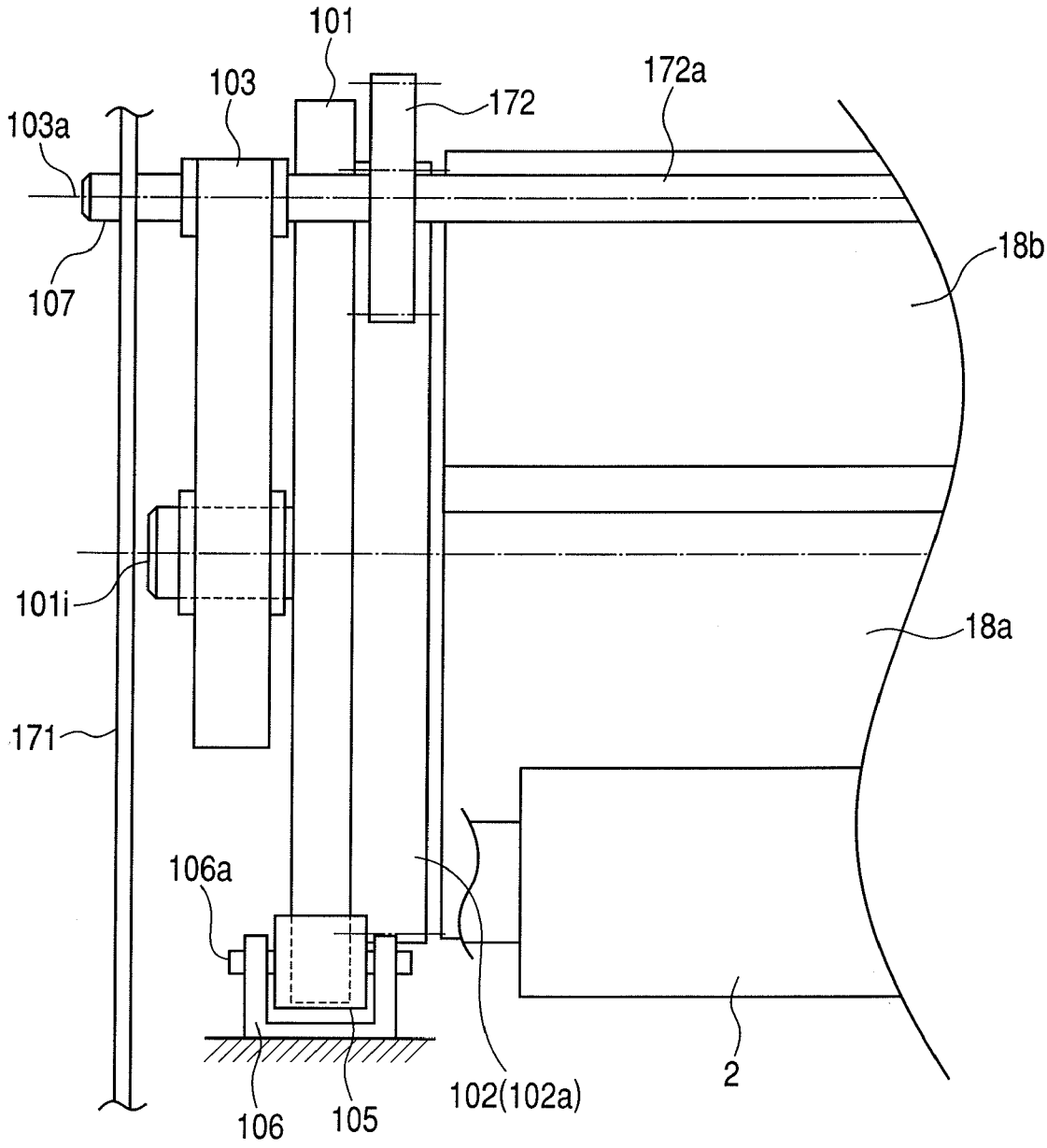
FIG. 4 is a right side view illustrating the changeover mechanism of the developing device according to the first embodiment.

Upon receiving the rotating force from the motor M, the drive gear 172 rotates in the direction indicated by the arrow A (FIG. 2). Then, as described above, the rotary 102 rotates in the direction indicated by the arrow B (FIG. 2). Then, the cam 101 that is disposed in the rotary 102 also rotates integrally with the rotary 102 in the direction indicated by the arrow B. FIG. 4 illustrates a state in which the development of the developing device 18*a* is completed, the developing device 18*a* is retreated from the development position 18X, and the developing device 18*b* moves toward the development position 18X.

In this embodiment, the arm (pivotably movable member) 103 is rotatably supported by the main body A of the image forming apparatus. Also, the arm 103 supports the rotating center 101*i* of the rotary (rotary supporting member) 102. The rotating center 101*i* is the rotating center of the cam (rotary member) 101. Also, the cam 101 is fitted to the rotary 102. Therefore, the arm 103 supports the rotating center 101*i* of the cam 101.

Also, the rotary 102 has a gear portion (rotary supporting member gear) 102*a* that is disposed over the overall periphery of the rotary 102 along the rotating direction thereof. Then, the drive gear (pivotably movable member gear) 172 is disposed on the same axial line as that of the rotating center 103*a* at which the arm 103 is rotatably supported to the apparatus main body A, which makes the gear 172 and the gear position 102*a* engaged with each other. With the above configuration, even when the arm 103 pivotably moves, the gear 172 and the gear portion 102*a* can be always kept to be engaged with each other. The same is applied to the following embodiments.

The rotating center 103*a* is the axial line of the shaft 172*a* that rotatably supports the gear 172. The shaft 172*a* is fixed to the main body frame 171. Then, one end of the arm 103 is rotatably fitted to the shaft 172*a*.

As described above, as illustrated in FIGS. 2 and 3, the elastic force (biasing force) of the spring 104 is exerted as a force by which the development roller 182*a* comes in pressure contact with the photosensitive drum 2. The rotary 102 rotates from that state, to thereby release the pressure contact state of the development roller 182*a* and the photosensitive drum 2. Then, when the pressure contact state is released, the biasing force of the spring 104 is exerted as the force by which the cam 101 comes in pressure contact with the rotatable member 105. With the above operation, the cam 101 can be surely brought in contact with the rotatable member 105.

The outer peripheral surface of the cam 101 except for portions at which the spacing portions (recesses) 101*a* to 101*d* are disposed is the contacting portions 101*e* to 101*h* that are in contact with the rotatable member 105. In the state in which the contacting portions 101*e* to 101*h* are in contact with the rotatable member 105, the developing devices 18*a* to 18*d* are configured to be out of contact with the photosensitive drum 2. Therefore, the developing devices 18*a* to 18*d* can be sequentially moved to the development position without adversely affecting the photosensitive drum 2. The contacting portions 101*e* to 101*h* and the spacing portions 101*a* to 101*d* are arranged in alternating order along the rotating direction of the cam 101 (rotary 102). A distance L1 between the spacing portions 101*a* to 101*d* and the rotating center 101*i* of the cam 101 is shorter than a distance L2 between the contacting portions 101*e* to 101*h* and the rotating center 101*i* of the cam 101 (FIG. 5).

Then, when the developing device 18*b* (to 18*d*) is moved to the development position 18X, a controller (not shown)

blocks the rotating force of the drive roller 172, and the rotary 102 stops rotating. Then, the developing device 18*b* reaches the development position 18X. At the development position 18X, the development roller 182*b* (to 182*d*) comes in pressure contact with the photosensitive drum 2. In that state, as illustrated in FIG. 2, the rotatable member 105 faces the spacing portion (recess) 101*b* (to 101*d*) of the cam 101 at a distance. The spacing portion 101*b* (to 101*d*) and the rotatable member 105 are spaced from each other. Then, the respective development devices 18*a* to 18*d* sequentially move to the development position 18X while the above operation is repeated. In this embodiment, a gap G (FIG. 2) between the rotatable member 105 and the bottom surface of the recess 101*b* as the spacing portion is about 1.5 mm.

As described above, in this embodiment, the rotary 102 is integrated with the cam 101 having the contacting portions 101*e* to 101*h* and the spacing portions 101*a* to 101*d*, and the rotatable member 105 is disposed in the apparatus main body A. As a result, with only the rotation of the rotary 102, the developing devices 18*a* to 18*d* (development rollers 182*a* to 182*d*) can be brought in contact with or spaced from the photosensitive drum 2 while the developing devices 18*a* to 18*d* are rotationally moved. For that reason, the configuration in which the rotary 102 is rotated to move the respective developing devices 18*a* to 18*d* to the development position 18X can be easily provided. Hence, the costs of the apparatus can be reduced. Also, the apparatus can be downsized. Further, the developing devices 18*a* to 18*d* (development rollers 182*a* to 182*d*) can be brought in contact with or spaced from the photosensitive drum 2 while being rotationally moved. For that reason, the changeover operation is simplified as compared with the conventional operation, to thereby enable the operating time to be reduced.

Now, a modified example of the cam 101 is described with reference to FIGS. 6A and 6B.

Figure 6A:
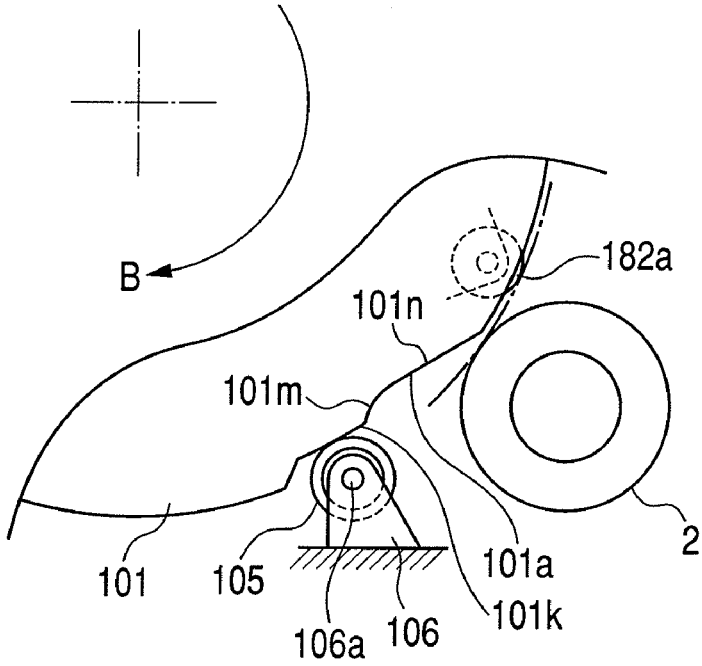
FIGS. 6A and 6B are enlarged diagrams illustrating a main portion of the proximity of a recess, respectively.
Figure 6B:
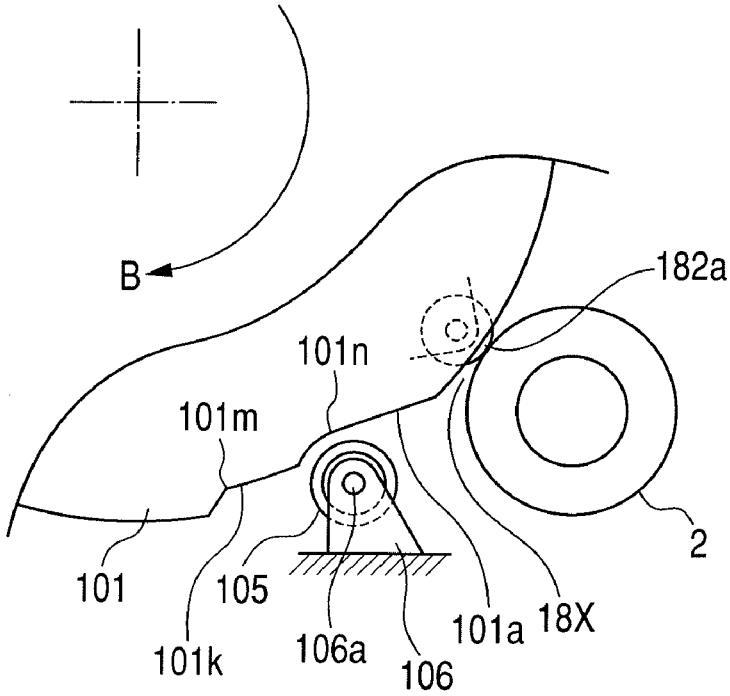

FIGS. 6A and 6B are enlarged diagrams of the main portions illustrating states of the proximity of the spacing portion (recess) of the cam 101. FIG. 6A is a diagram illustrating the state before the development roller 182*a* is in contact with the photosensitive drum 2 (before the development roller 182*a* reaches the development position 18X). FIG. 6B is a diagram illustrating the state in which the development roller 182*a* is in contact with the photosensitive drum 2 (when the development roller 182*a* reaches the development position 18X).

The cam 101 illustrated in FIGS. 6A and 6B has a contact assist portion 101*k* in addition to the above contacting portions and spacing portions. As illustrated in FIG. 6A, the contact assist portion 101*k* brings the development roller 182*a* that has not yet come in contact with the photosensitive drum 2 in contact with the regulating rotatable member 105 so as to keep the development roller 182*a* at the substantially same position as that of being in contact with the photosensitive drum 2. In this example, only the peripheral portion of the development roller 182*a* is illustrated, but the same is applied to the peripheries of the other development rollers.

That is, in this embodiment, the contact assist portion 101*k* is disposed in the spacing portions 101*a* to 101*d*. The assist portion 101*k* is disposed downstream of the spacing portions 101*a* to 101*d* in the rotating direction B. Thus, the assist portion 101*k* comes in contact with the rotatable member 105 before the development rollers 182*a* to 182*d* come in contact with the photosensitive drum 2. Accordingly, the development rollers 182*a* to 182*d* that have not yet come in contact with the photosensitive drum 2 can be positioned on the substantially same rotating trajectory as the position of being in contact with the photosensitive drum 2.

With the above configuration, as illustrated in FIG. 6B, the development roller 182*a* comes in contact with the photosensitive drum 2 at the substantially same position as the position of being in contact with the photosensitive drum 2. That is, the development roller 182*a* approaches the photosensitive drum with the substantially same rotating trajectory as the case where the development roller 182*a* comes in contact with the photosensitive drum 2. For that reason, it is possible to reduce an impact occurring when the development roller 182*a* and the photosensitive drum 2 come in contact with each other. Therefore, this embodiment has advantages such as an improvement in image quality, a reduction in aberration of the development roller 182*a* or the photosensitive drum 2, and a reduction in noise. However, the present invention is not limited to the above configuration. The present invention is also applicable in a case where the assist portion 101*k* is not disposed.

The rotary 102, the arm 103, the cam 101, and the regulating rotatable member 105 are arranged at one end and another end of the longitudinal direction of the developing devices 18*a* to 18*d* which are supported by the rotary 102. Then, in a state in which the developing devices 18*a* to 18*d* are positioned at the standby position 18Y where no development is conducted, the lower portion of the rotary 102 that is arranged at the above one end is supported by the rotatable member 105 that is arranged at the above one end (FIG. 5). Also, the lower portion of the rotary 102 that is arranged at the above another end is supported by the rotatable member 105 that is arranged at the above another end. With the above configuration, the pivotal movement of the rotary 102 is regulated by the rotatable member 105. Also, in a state in which the rotaries 102 are positioned at the development positions 18X, the pivotal movement of the rotaries 102 that are arranged at the one end and the another end is regulated by bringing the development rollers 182*a* to 182*d* in contact with the photosensitive drum 2.

As described above, the shape of the cam 101 is variously changed, thereby enabling diverse contacting methods and contact releasing (spacing) methods.

Second Embodiment

Next, another embodiment of a drive transmission mechanism that rotates a rotary 102 is described with reference to FIGS. 7 and 8.

Figure 7:
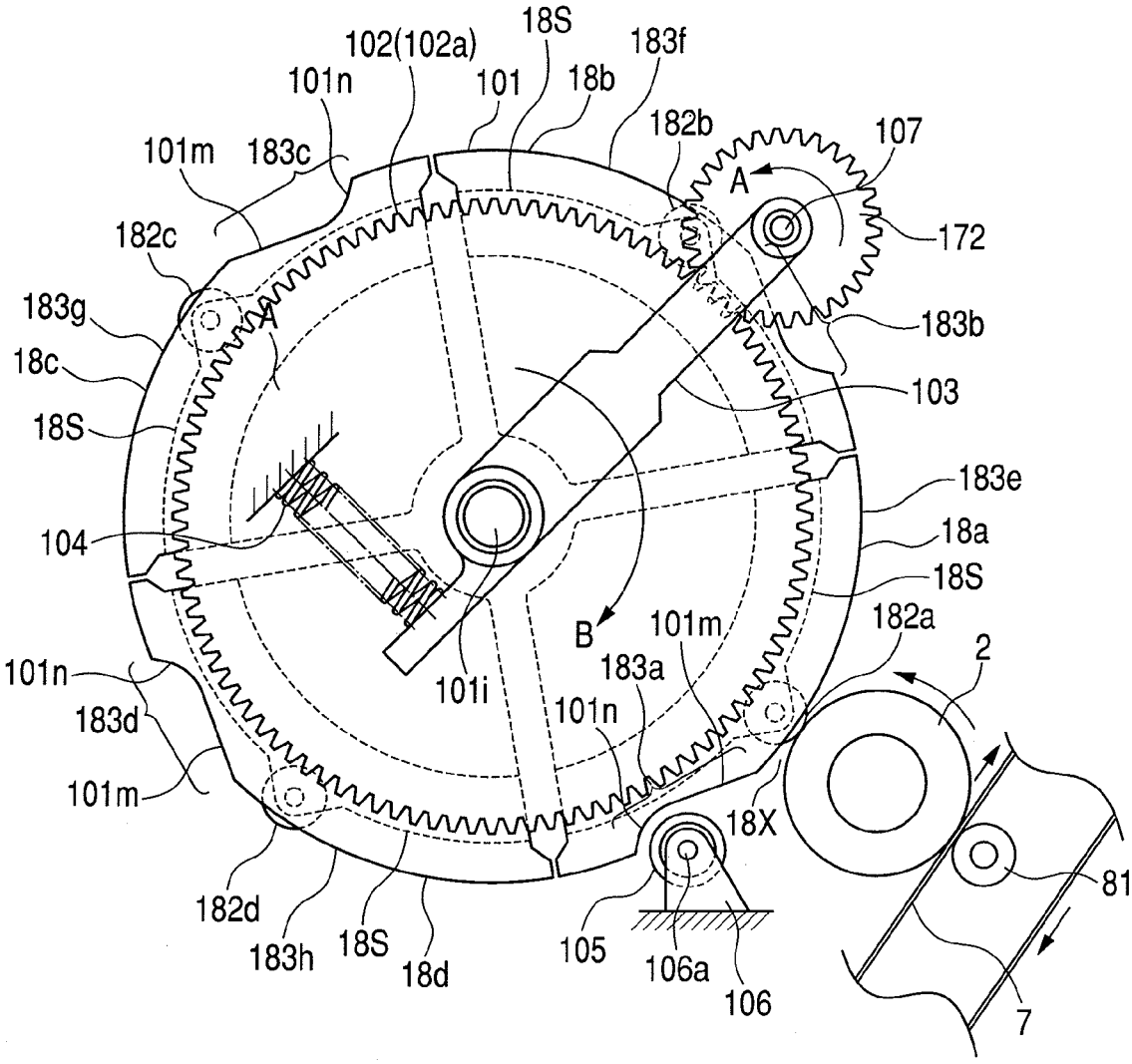
FIG. 7 is a front view illustrating a general configuration of a changeover mechanism of a developing device according to a second embodiment.

FIG. 7 is a front view illustrating a configuration of the drive transmission mechanism in which a development roller 182*a* is at the development position that faces a photosensitive drum 2. FIG. 8 is a right side view of FIG. 7 viewed from the right direction. FIG. 7 does not illustrate the main body frame 171 illustrated in FIG. 8. Also, FIG. 8 does not illustrate the transfer belt 7 and the transfer roller 81 illustrated in FIG. 7.

In this embodiment, a cam 183 as the rotary member (guide member) which rotates integrally with the rotary 102 is disposed in the respective developing devices 18*a* to 18*d* that are supported by the rotary 102. Other configurations and operations are identical with those in the above embodiment.

Figure 8:
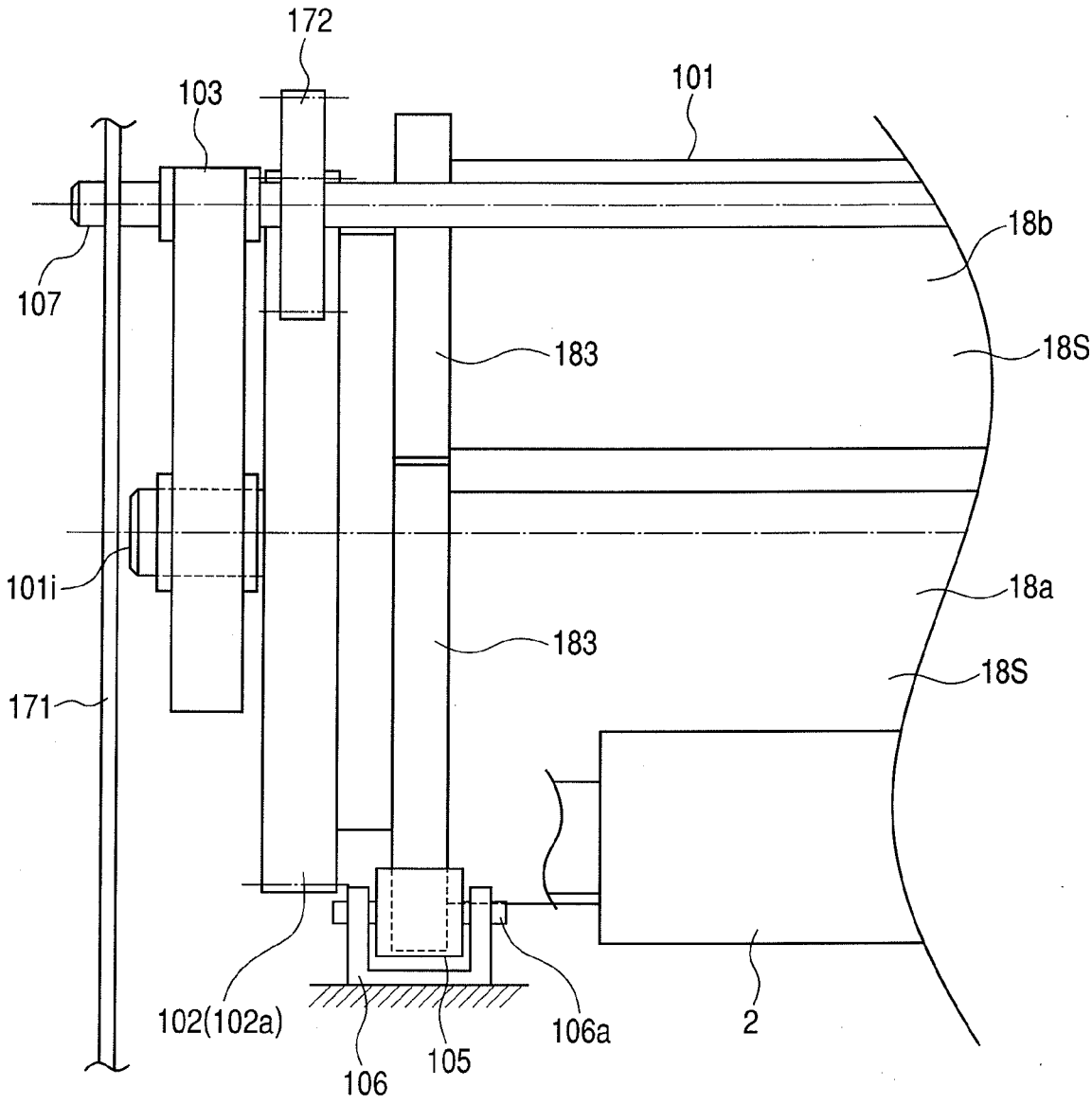
FIG. 8 is a right side view illustrating the changeover mechanism of the developing device according to the second embodiment.

As illustrated in FIGS. 7 and 8, the respective developing devices 18*a* to 18*d* include contacting portions 183*e* to 183*h* that come in contact with the regulating rotatable member 105, and spacing portions (recesses, contact release portions) 183*a* to 183*d* that release the regulation of the regulating rotatable member 105. The contacting portions and the spacing portions are disposed on an outer surface of an outer frame 18S of the developing devices. The contacting portions and the spacing portions have the same configuration (shape) as that of the above embodiment. Also, the spacing portions (recesses) 183*a* to 183*d* are out of contact with the rotatable member 105 during the development (when the development roller and the photosensitive drum come in contact with each other) as with the spacing portions of the cam 101 in the above embodiment. Then, the biasing force (elastic force) of an arm spring (elastic member) is exerted as a force by which the development roller 182*a* comes in pressure contact with the photosensitive drum 2. On the other hand, in order to move the subsequent developing device to the development position 18X, when the rotary 102 rotates due to the rotating force of a drive gear 172, the respective spacing portions 183*a* to 183*d* are brought in pressure contact with the rotatable member 105. With the above operation, the respective development rollers 182*a* to 182*d* are spaced from the photosensitive drum 2.

As described above, according to this embodiment, the cam 183 having the contacting portions 183*e* to 183*h* and the spacing portions (recesses) 183*a* to 183*d* are disposed in the respective developing devices 18*a* to 18*d*. With the above operation, the cam 101 described in the above embodiment can be eliminated. As a result, the apparatus can be further downsized.

Similarly, in this embodiment, the contact assist portion (FIGS. 6A and 6B) can also be disposed as in the above embodiment.

Third Embodiment

Subsequently, another embodiment of the drive transmission mechanism that rotates the rotary 102 is described in detail with reference to FIGS. 9 and 10.

Figure 9:
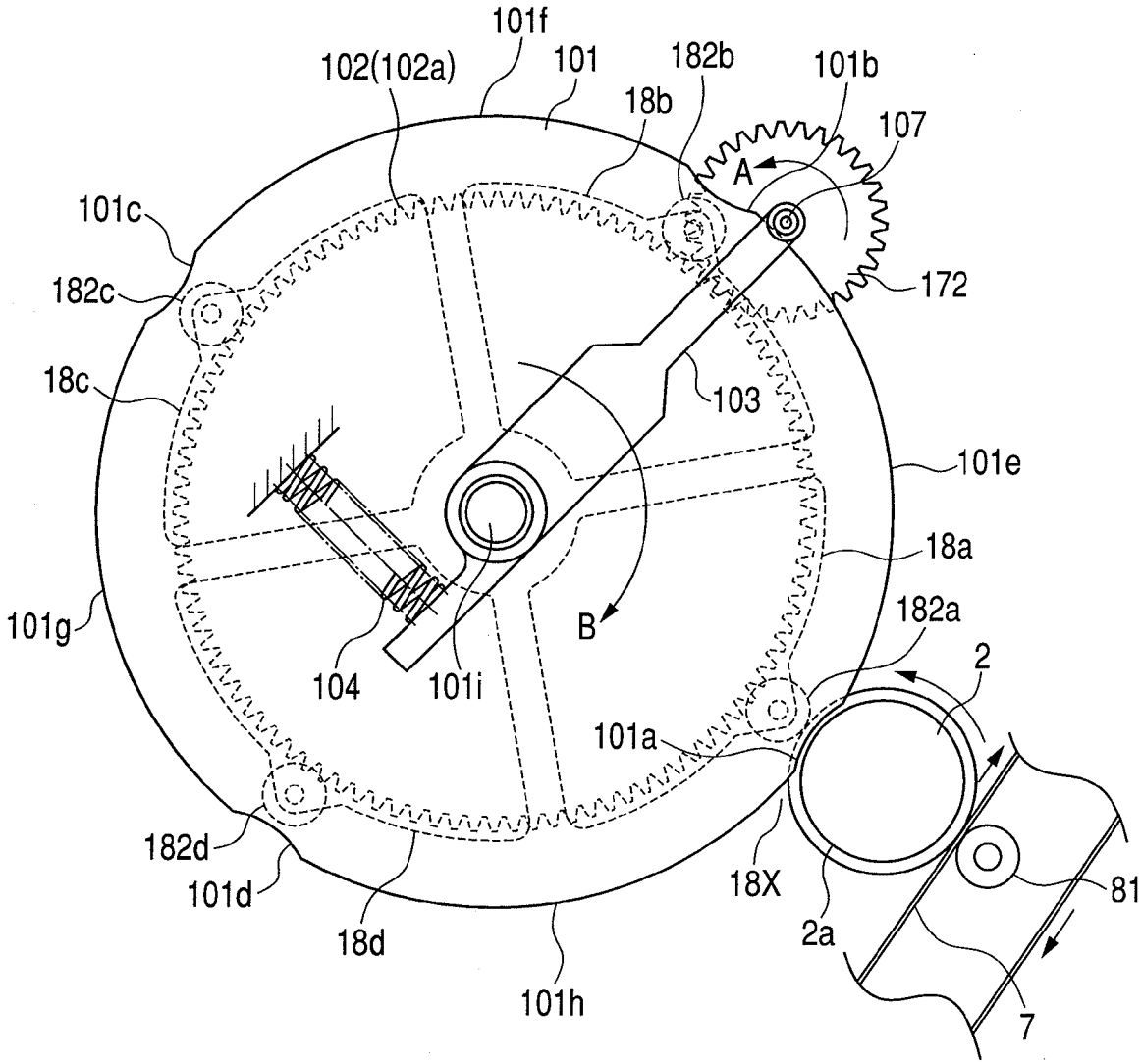
FIG. 9 is a front view illustrating a general configuration of a changeover mechanism of a developing device according to a third embodiment.
Figure 10:
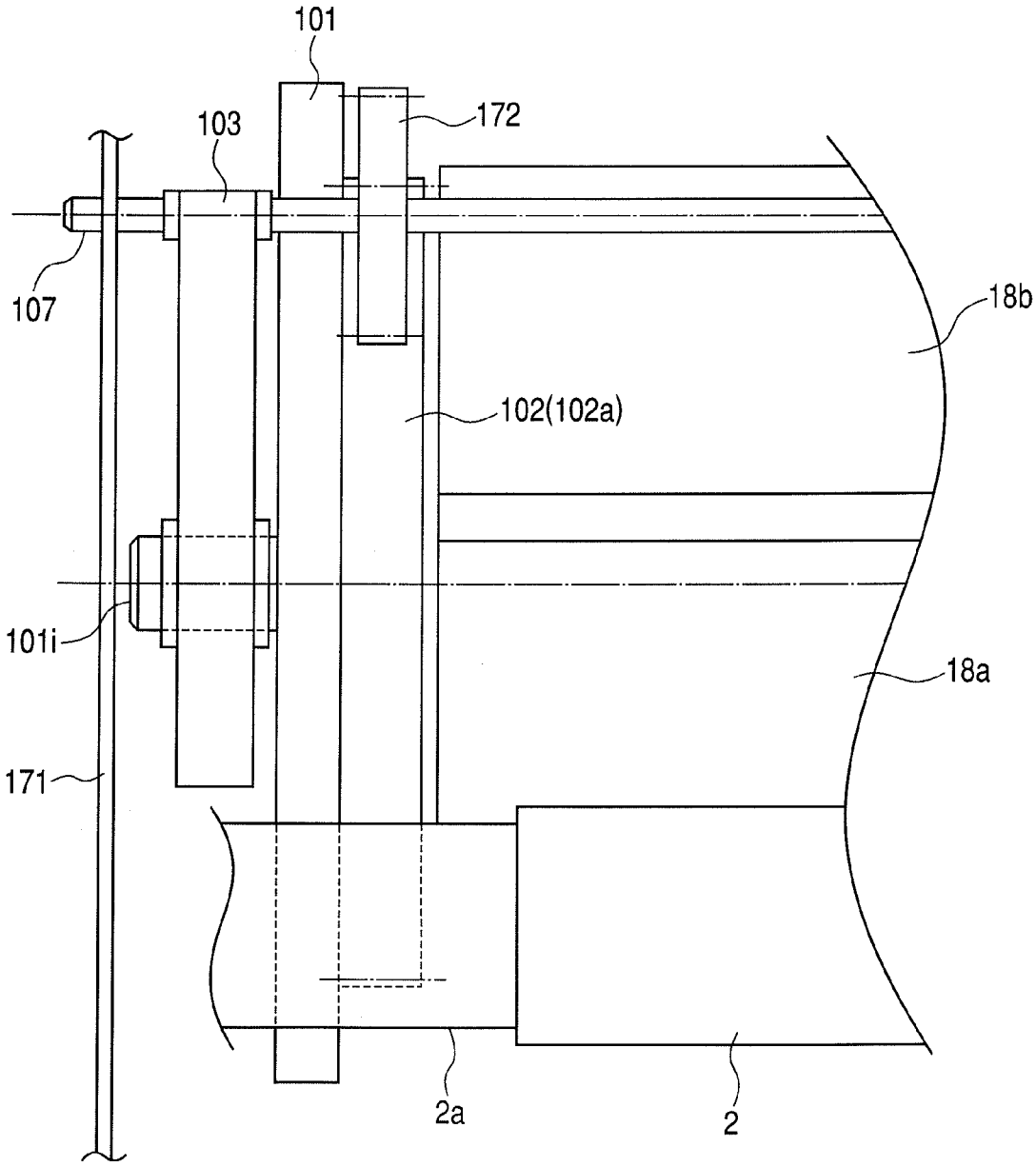
FIG. 10 is a right side view illustrating the changeover mechanism of the developing device according to the third embodiment.

FIG. 9 is a front view illustrating the configuration of the drive transmission mechanism in which a development roller 182*a* is positioned at the development position that faces a photosensitive drum 2. FIG. 10 is a right side view of FIG. 9 viewed from the right direction. FIG. 9 does not illustrate the main body frame 171 illustrated in FIG. 10. Also, FIG. 10 does not illustrate the transfer belt 7 and the transfer roller 81 illustrated in FIG. 10.

In this embodiment, the above regulating member is integrated with the photosensitive drum 2. That is, a support bar 2*a* that supports the photosensitive drum 2 also functions as the regulating member that regulates the pivotal movement of the rotary. In this embodiment, the support bar 2*a* has the function of the regulating rotatable member 105 in the above embodiment. This embodiment obtains the same results as those in the above embodiment. Other configurations and operations are identical with those in the above embodiment.

A cam 101 rotates integrally with the rotary 102. Then, contacting portions 101*e* to 101*h* are brought in contact with the support bar 2*a* of the photosensitive drum 2. With the above operation, a development roller 182*a* is apart from the photosensitive drum 2. On the other hand, as illustrated in FIG. 9, in a state in which the development roller 182*a* is in contact with the photosensitive drum 2, the cam 101 is apart from the support bar 2*a* by the spacing portion (recess) 101*a*. Similarly, in the other developing devices, the cam 101 is apart from the support bar 2*a* by the respective spacing portions (recesses) 101*b* to 101*d* in the state in which the development roller is in contact with the photosensitive drum 2.

The photosensitive drum 2 and the support bar 2*a* are originally the constituent parts of the image forming apparatus. In the above embodiment, the photosensitive drum 2 and the support bar 2*a* bear the pivotal movement of the rotary 102. As a result, the regulating rotatable member 105 and a rotatable member holder 106 as the regulating member in the above embodiment can be eliminated. For that reason, the costs can be reduced, and the space can be reduced.

Also, the above-mentioned contact assist member can be disposed in the cam as described in the above first embodiment. According to this configuration, the tolerance of parts such as the regulating rotatable member 105 that constitutes the regulating member and the rotatable member holder 106 is not effected when the development roller comes in contact with the photosensitive drum 2 in the substantially contact state.

The regulating member (rotatable member 105, rotatable member holder 106) may be integrated with a unit (not shown) that supports the photosensitive drum 2.

As described above, according to this embodiment, the regulating member is integrated with the photosensitive drum 2 or a unit (not shown) that supports the photosensitive drum 2.

Fourth Embodiment

Subsequently, another embodiment of the drive transmission mechanism that rotates the rotary 102 is described with reference to FIGS. 11 and 12.

Figure 11:
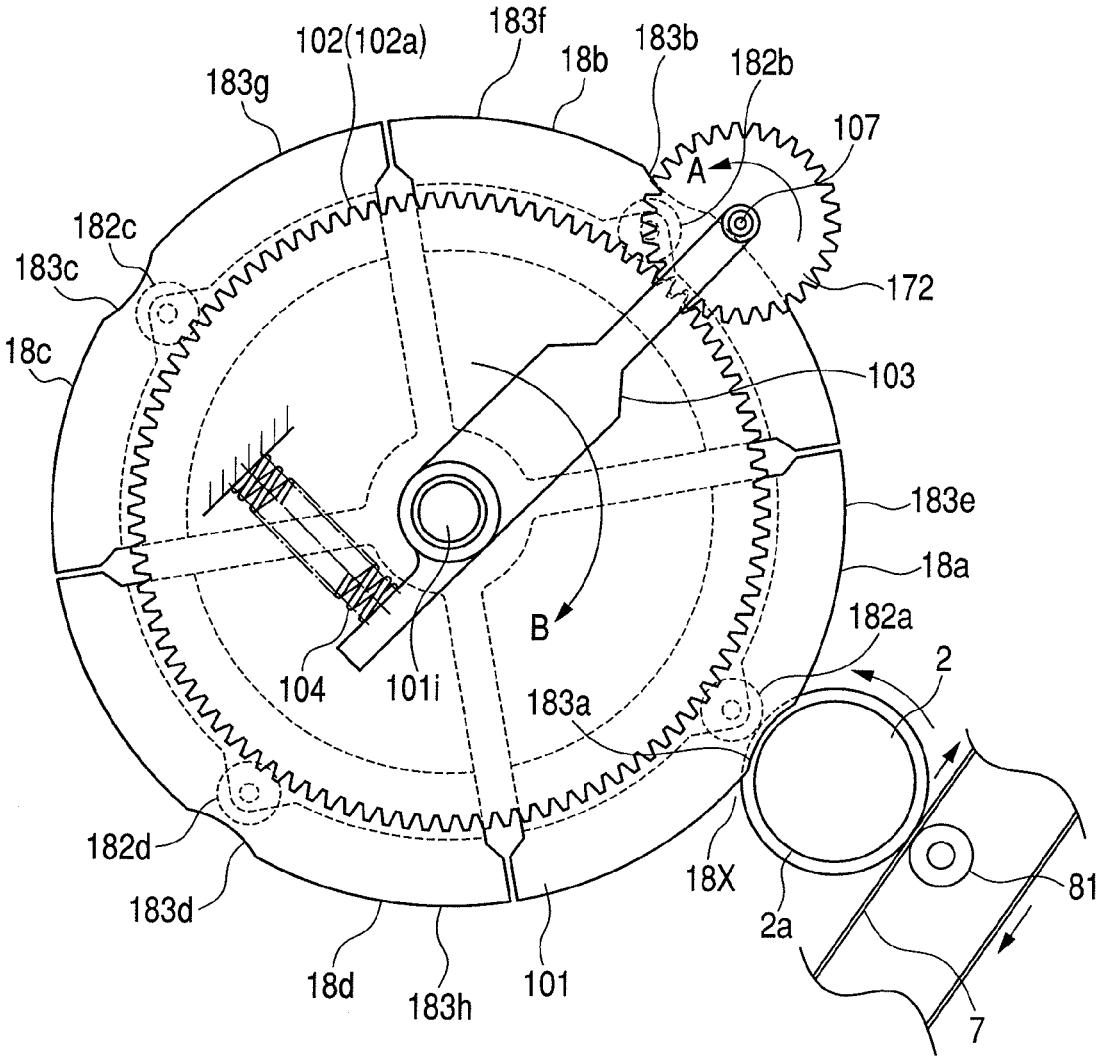
FIG. 11 is a front view illustrating a general configuration of a changeover mechanism of a developing device according to a fourth embodiment.
Figure 12:
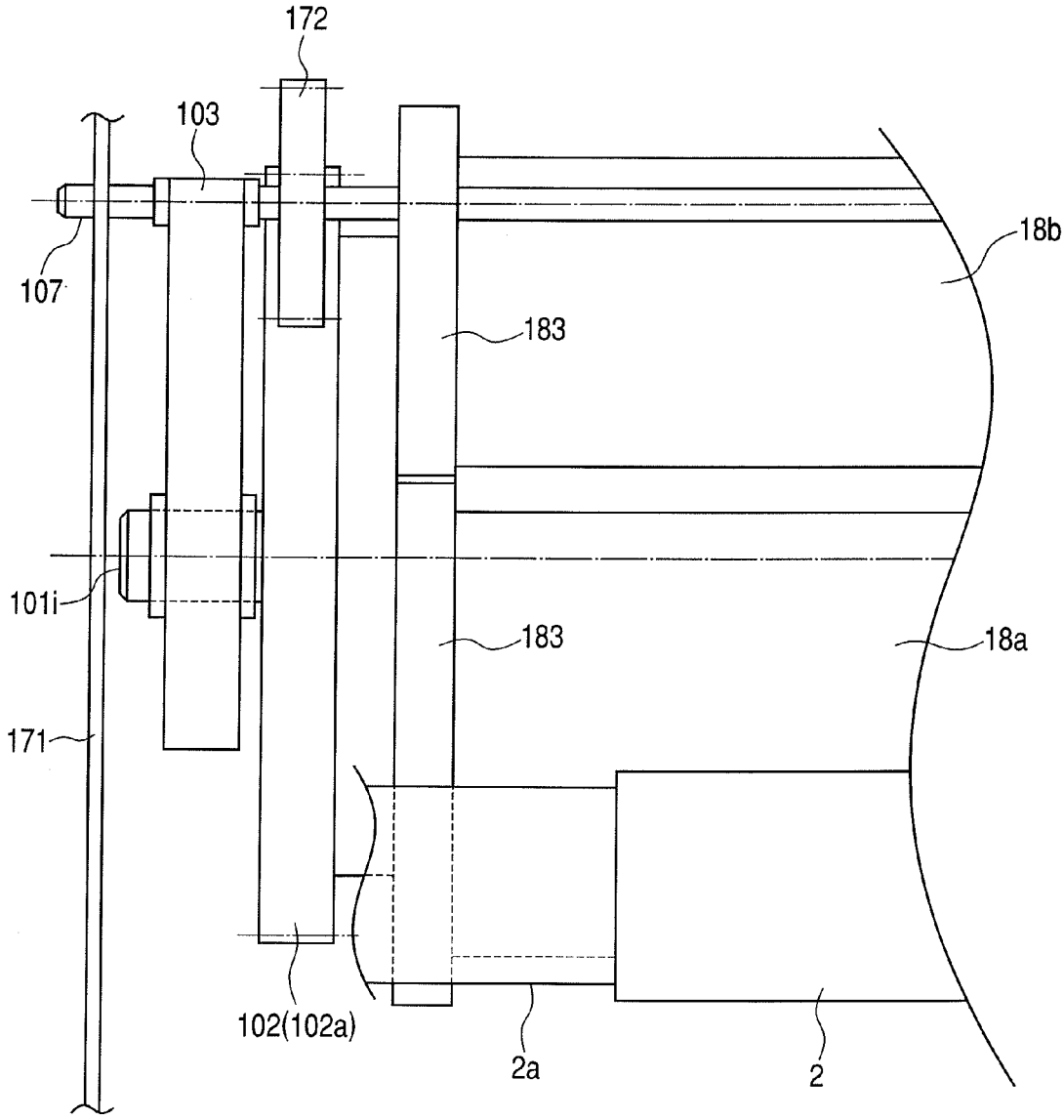
FIG. 12 is a right side view illustrating the changeover mechanism of the developing device according to the fourth embodiment.

FIG. 11 is a front view illustrating a general configuration of a drive transmission mechanism in which a development roller 182*a* is positioned at a development position 18X, which is in a developing state. FIG. 12 is a right side view of FIG. 11 viewed from the right direction. FIG. 11 does not illustrate the main body frame 171 illustrated in FIG. 12. FIG. 12 does not illustrate the transfer belt 7 and the transfer roller 81 illustrated in FIG. 11.

This embodiment configures the combination of the above second and third embodiments together. That is, the cam 183 which functions as the rotary member (guide member) that rotates integrally with the rotary 102 is disposed in the respective developing devices 18*a* to 18*d* that are supported by the rotary 102. Also, the regulating member is integrated with the photosensitive drum 2. In this example, the support bar 2*a* that supports the photosensitive drum 2 also functions as the regulating member that regulates the pivotal movement of the rotary. The other configurations and operations are identical with those in the above embodiment.

According to this embodiment, the cam 101, the regulating rotatable member 105, and the rotatable member holder 106 in the above embodiment can be eliminated. For that reason, the costs can be reduced, and the space can be reduced.

Similarly, in this embodiment, the above-mentioned contact assist portion (FIGS. 6A and 6B) can be provided as in the above embodiment. According to the configuration in which the contact assist portion is provided, when the development roller comes in contact with the photosensitive drum 2 in the substantially contact state, the tolerance of parts such as the cam 101, the regulating rotatable member 105, and the rotatable member holder 106 is not added.

Also, in the above embodiment, the printer is exemplified as the image forming apparatus. However, the present invention is not limited to the printer. For example, the present invention can be applied to another image forming apparatus such as a copying machine or a facsimile machine, or another image forming machine such as a complex machine that combines those functions together. Also, the above embodiment is exemplified by the image forming apparatus in which the intermediate transfer member (belt) is used, the toner images of respective colors are sequentially superimposed and transferred onto the intermediate transfer member, and the toner images that have been borne on the intermediate transfer member are transferred on the recording material together. However, the present invention is not limited to the above image forming apparatus. For example, the present invention can be applied to an image forming apparatus in which the recording medium carrier is used, and the developer images of respective colors are sequentially superimposed and transferred onto the recording medium that is borne on the recording medium carrier. The present invention is applied to the above image forming apparatus, thereby enabling the same advantages as those described above to be obtained.

In the respective embodiments, the development rollers 182*a* to 182*d* conduct the development of the electrostatic latent image in a state in which the development rollers 182*a* to 182*d* are in contact with the photosensitive drum 2 (so-called contact phenomenon). For that reason, the configuration in which the development rollers 182*a* to 182*d* are in contact with the photosensitive drum 2 at the development position 18X is described. However, the present invention is not limited to the above configuration. The present invention can be also applied to a configuration in which the development rollers 182*a* to 182*d* are out of contact with the photosensitive drum 2 at the development position 18X. According to the present invention, spacer rotatable members that are disposed at one ends and another ends of the development rollers 182*a* to 182*d* are brought in contact with the end of the photosensitive drum 2 at the development position 18X. As a result, the present invention can be also applied to a configuration in which the development roller and the photosensitive drum 2 are brought close to each other.

According to the above respective embodiments, when the developing devices 18*a* to 18*d* are moved with the rotation of the rotary 102, the developing device can be moved in a state in which the developing device is far from the development position 18X in the intersecting direction intersecting with the rotating direction B of the rotary 102.

As described above, according to the above respective embodiments, the supported developing devices 18*a* to 18*d* can be moved to the development position 18X from the rotating direction B of the rotary 102, and the developing devices 18*a* to 18*d* can be moved to the development position 18X from the intersecting direction intersecting with the rotating direction B. With the above configuration, the developing device that is supported by the rotary 102 can be rotationally moved from the photosensitive drum 2 in a direction crossing the rotating direction B so as to be farther from the photosensitive drum 2.

Also, according to the above respective embodiments, the supported developing devices 18*a* to 18*d* can be made far from the development position 18X in the rotating direction B of the rotary 102, and the developing devices 18*a* to 18*d* can be made far from the development position 18X in the intersecting direction intersecting with the rotating direction B. The developing devices 18*a* to 18*d* can be moved in the rotating direction B in a state in which the developing devices 18*a* to 18*d* are far in the intersecting direction.

According to the above embodiments, the developing devices 18*a* to 18*d* go away from the development position 18X in the direction intersecting with the rotating direction B of the cam 101 by the rotation of the cam 101 to get to the retreat position. In the specification, the standby position 18Y is a position in which the developing devices 18*a* to 18*d* are out of the development position in the rotating direction B. The developing device positioned in the standby position 18Y is also positioned in the retreat position. Then, the developing devices 18*a* to 18*d* positioned in the retreat position are moved to the development position 18X in the intersecting direction intersecting with the rotating direction B in accordance with the rotation of the cam 101.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2007-128984, filed May 15, 2007 and No. 2008-112002, filed Apr. 23, 2008, which are hereby incorporated by reference herein in their entirety.

What is claimed is:

1. A color electrophotographic image forming apparatus which forms an image on a recording medium, the color electrophotographic image forming apparatus comprising:

an electrophotographic photosensitive drum;

a rotary supporting member which supports a plurality of developing devices for developing an electrostatic latent image formed on the electrophotographic photosensitive drum, and rotates to sequentially move in a rotating direction the supported plurality of developing devices to a development position at which the electrostatic latent image is developed;

a motor;

a pivotally movable member which pivotably supports the rotary supporting member;

a rotary member which rotates integrally with the rotary supporting member which rotates while receiving a rotating force from the motor, the rotary member including a spacing portion for moving one of the plurality of developing devices which is supported by the rotary supporting member to the development position in an intersecting direction intersecting with the rotating direction of the rotary supporting member, and a contacting portion for moving one of the plurality of developing devices to a retreat position to which one of the plurality of developing devices is retreated from the development position in the intersecting direction; and a regulating member which regulates a pivotal movement of the rotary supporting member in a state in which the regulating member is in contact with the contacting portion, the regulating member being disposed at a position facing the spacing portion which rotates according to a rotation of the rotary member at a distance in order to move one of the plurality of developing devices to the development position in the intersecting direction, and at a position in which the regulating member contacts the contacting portion which rotates according to the rotation of the rotary member in order to move one of the plurality of developing devices to the retreat position in the intersecting direction, wherein the rotary supporting member pivotally moves so that one of the plurality of developing devices is positioned at the development position in a state in which the regulating member is apart from the spacing portion, and so that one of the plurality of developing devices is positioned at the retreat position in a state in which the regulating member is in contact with the contacting portion.

2. A color electrophotographic image forming apparatus according to claim 1, wherein the rotary member is positioned at one end in a longitudinal direction of the plurality of developing devices which are supported by the rotary supporting member, and integrated with the rotary supporting member, the contacting portions and the spacing portions are arranged in alternating order along the rotating direction of the rotary supporting member, and a distance between the spacing portions and a rotating center of the rotary supporting member is shorter than a distance between the contacting portions and the rotating center of the rotary supporting member.

3. A color electrophotographic image forming apparatus according to claim 1, wherein the spacing portions comprise recesses which are provided in a recessed manner at a plurality of portions of the rotary member along the rotating direction of the rotary member, and each of the recesses has a bevel rising from a downstream side toward an upstream side in the rotating direction.

4. A color electrophotographic image forming apparatus according to claim 3, wherein the pivotably movable member is pivotably supported by a main body of the color electrophotographic image forming apparatus, and supports the rotating center of the rotary supporting member.

5. A color electrophotographic image forming apparatus according to claim 4, wherein the rotary supporting member has a rotary supporting member gear disposed along the rotating direction, a pivotably movable member gear is disposed coaxially with a rotating center which rotatably supports the pivotably movable member to the main body, and the rotary supporting member gear and the pivotably movable member gear are engaged with each other.

6. A color electrophotographic image forming apparatus according to claim 4, wherein the regulating member comprises an elastic rotatable member rotatably supported by a shaft which is fixed to the main body of the color electrophotographic image forming apparatus, the shaft supporting the elastic rotatable member is arranged in parallel to a rotation axis of the rotary supporting member, and the elastic rotatable member is rotated in contact with the contacting portion of the rotary member when the rotary member rotates.

7. A color electrophotographic image forming apparatus according to claim 6, wherein the rotary supporting member, the pivotably movable member, the rotary member, and the elastic rotatable member are arranged at each of one end and the other end in the longitudinal direction of the plurality of developing devices which are supported by the rotary supporting member, and in a state in which one of the plurality of developing devices is positioned at a standby position in which the one of the plurality of developing devices does not perform a development, a lower portion of the rotary supporting member arranged at the one end is supported by the elastic rotatable member arranged at the one end, and a lower portion of the rotary supporting member arranged at the other end is supported by the elastic rotatable member arranged at the other end so that the pivotal movement of the rotary supporting member is regulated by the elastic rotatable members.

8. A color electrophotographic image forming apparatus according to claim 1, wherein the spacing portion has a contact assist portion which comes in contact with the regulating member before a development roller comes in contact with the electrophotographic photosensitive drum in order to position the development roller of one of the plurality of developing devices which is not yet to come in contact with the electrophotographic photosensitive drum at the substantially same position as a position in which the development roller is in contact with the electrophotographic photosensitive drum.

9. A color electrophotographic image forming apparatus according to claim 1, wherein the rotary member is provided integrally with each of the plurality of developing devices, which are supported by the rotary supporting member.

10. A color electrophotographic image forming apparatus according to claim 1, wherein the regulating member is provided integrally with the electrophotographic photosensitive drum or a unit which supports the electrophotographic photosensitive drum.

11. A color electrophotographic image forming apparatus which forms an image on a recording medium, the color electrophotographic image forming apparatus comprising:

an electrophotographic photosensitive drum;

a rotary supporting member which supports a plurality of developing devices for developing an electrostatic latent image formed on the electrophotographic photosensitive drum, and rotates to sequentially move in a rotating direction the supported plurality of developing devices to a development position in which the electrostatic latent image is developed;

a motor;

a pivotally movable member which is pivotably supported by a main body of the color electrophotographic image forming apparatus, and pivotably supports the rotary supporting member;

a rotary member which rotates integrally with the rotary supporting member which rotates while receiving a rotating force from the motor, the rotary member including spacing portions for moving one of the plurality of developing devices which is supported by the rotary supporting member to the development position in an intersecting direction intersecting with the rotating direction of the rotary supporting member, and contacting portions for moving one of the plurality of developing devices in the intersecting direction to a retreat position to which the one of the plurality of developing devices is retreated from the development position, the spacing portions and the contacting portions being arranged in alternating order along the rotating direction of the rotary supporting member, a distance between the spacing portions and a rotating center of the rotary supporting member being shorter than a distance between the contacting portions and the rotating center of the rotary supporting member, the spacing portions comprising recesses each having a bevel rising from a downstream side toward an upstream side of the rotating direction;

a rotary supporting member gear which is disposed along the rotating direction of the rotary supporting member;

a pivotably movable member gear which is arranged coaxially with a rotating center which pivotably supports the pivotably movable member to the main body, and engaged with the rotary supporting member gear; and an elastic rotatable member which is disposed at a position in which the elastic rotatable member comes into contact with the contacting portion which rotates according to a rotation of the rotary member, and at a position in which the elastic rotatable member faces the spacing portion which rotates according to the rotation of the rotary member at a distance, a rotating axis of the elastic rotatable member being arranged in parallel to a rotating axis of the rotating supporting member, wherein the rotary supporting member pivotally moves so that one of the plurality of developing devices is positioned at the development position in a state in which the elastic rotatable member faces the spacing member at a distance, and so that one of the plurality of developing devices is positioned at the retreat position in a state in which the elastic rotatable member is in contact with the contacting portion.

12. A color electrophotographic image forming apparatus according to claim 11, wherein the rotary supporting member, the pivotably movable member, the rotary member, and the elastic rotatable member are arranged at each of one end and the other end of the longitudinal direction of the plurality of developing devices which are supported by the rotary supporting member, and in a state in which one of the plurality of developing devices is positioned at a standby position in which the one of the plurality of developing devices does not perform a development, a lower portion of the rotary supporting member arranged at the one end is supported by the elastic rotatable member arranged at the one end, and a lower portion of the rotary supporting member arranged at the other end is supported by the elastic rotatable member arranged at the other end so that the pivotal movement of the rotary supporting member is regulated by the elastic movable member.

* * * * *